US009402117B2

(12) United States Patent
McElveen

(10) Patent No.: US 9,402,117 B2
(45) **Date of Patent: *Jul. 26, 2016**

(54) WEARABLE DIRECTIONAL MICROPHONE ARRAY APPARATUS AND SYSTEM

(71) Applicant: James Keith McElveen, Charleston, SC (US)

(72) Inventor: James Keith McElveen, Charleston, SC (US)

(73) Assignee: Wave Sciences, LLC, Charleston, SC (US)

( * ) Notice: Subject to any disclaimer, the term of this patent is extended or adjusted under 35 U.S.C. 154(b) by 616 days.

This patent is subject to a terminal disclaimer.

(21) Appl. No.: 13/654,225

(22) Filed: Oct. 17, 2012

(65) Prior Publication Data

US 2013/0101136 A1 Apr. 25, 2013

Related U.S. Application Data

(60) Provisional application No. 61/548,778, filed on Oct. 19, 2011.

(51) Int. Cl.

| | |
|---|---|
| ***H04R 3/00*** | (2006.01) |
| ***H04R 1/02*** | (2006.01) |
| *H04R 1/10* | (2006.01) |
| *H04R 25/00* | (2006.01) |

(52) U.S. Cl.

CPC ..... *H04R 1/02* (2013.01); *H04R 3/005* (2013.01); *H04R 1/1083* (2013.01); *H04R 25/405* (2013.01); *H04R 2201/023* (2013.01); *H04R 2201/405* (2013.01); *H04R 2430/23* (2013.01)

(58) Field of Classification Search

CPC ..... H04R 3/005; H04R 1/406

See application file for complete search history.

(56) References Cited

U.S. PATENT DOCUMENTS

| | | | | |
|---|---|---|---|---|
| 5,289,544 | A | 2/1994 | Franklin | |
| 5,425,104 | A | 6/1995 | Shennib | |
| 5,682,434 | A | 10/1997 | Boyden | |
| 5,737,430 | A | 4/1998 | Widrow | |
| 6,733,457 | B2 * | 5/2004 | Flesch | A61B 8/12 600/459 |
| 6,826,782 | B2 * | 12/2004 | Jordan | 2/94 |
| 7,830,319 | B2 * | 11/2010 | Cohen et al. | 343/718 |
| 8,213,634 | B1 * | 7/2012 | Daniel | H04R 3/005 381/122 |
| 9,191,741 | B1 * | 11/2015 | Brusniak | H04R 1/406 |
| 2007/0274534 | A1 * | 11/2007 | Lockhart | H04R 1/406 381/92 |

(Continued)

FOREIGN PATENT DOCUMENTS

WO WO 2011087770 A2 * 7/2011

*Primary Examiner* — Matthew Eason
*Assistant Examiner* — Taunya McCarty
(74) *Attorney, Agent, or Firm* — Gregory Finch, Esq.

(57) ABSTRACT

A wearable microphone array apparatus and system used as a directional audio system and as an assisted listening device. The present invention advances hearing aids and assisted listening devices to allow construction of a highly directional audio array that is wearable, natural sounding, and convenient to direct, as well as to provide directional cues to users who have partial or total loss of hearing in one or both ears. The advantages of the invention include simultaneously providing high gain, high directivity, high side lobe attenuation, and consistent beam width; providing significant beam forming at lower frequencies where substantial noises are present, particularly in noisy, reverberant environments; and allowing construction of a cost effective body-worn or body-carried directional audio device.

20 Claims, 4 Drawing Sheets

(56) References Cited

U.S. PATENT DOCUMENTS

2010/0142328 A1* 6/2010 Beck ..... F41G 3/147 367/129
2011/0129110 A1* 6/2011 Wolfe ..... 381/333
2011/0225439 A1* 9/2011 Emori ..... H04R 3/005 713/320
2012/0177219 A1* 7/2012 Mullen ..... F41G 3/147 381/92
2012/0182834 A1* 7/2012 Mullen ..... F41G 3/147 367/118
2012/0275272 A1* 11/2012 Mullen ..... F41G 3/147 367/118

* cited by examiner

WEARABLE DIRECTIONAL MICROPHONE ARRAY APPARATUS AND SYSTEM

RELATED APPLICATIONS

This application claims the benefit of U.S. Provisional Application 61/548,778, filed Oct. 19, 2011, hereby incorporated by reference.

PARTIES TO A JOINT RESEARCH AGREEMENT

The presently claimed invention was made by or on behalf of the below listed parties to a joint research agreement. The joint research agreement was in effect on or before the date the claimed invention was made and the claimed invention was made as a result of activities undertaken within the scope of the joint research agreement. The parties to the joint research agreement are DANIEL TECHNOLOGY INC. and JAMES KEITH MCELVEEN.

FIELD

The present invention is in the technical field of directional audio systems, in particular, microphone arrays used as directional audio systems and microphone arrays used as assisted listening devices and hearing aids.

BACKGROUND

Directional audio systems work by spatially filtering received sound so that sounds arriving from the look direction are accepted (constructively combined) and sounds arriving from other directions are rejected (destructively combined). Effective capture of sound coming from a particular spatial location or direction is a classic but difficult audio engineering problem. One means of accomplishing this is by use of a directional microphone array. It is well known by all persons skilled in the art that a collection of microphones can be treated together as an array of sensors whose outputs can be combined in engineered ways to spatially filter the diffuse (i.e. ambient or non-directional) and directional sound at the particular location of the array over time.

The prior art includes many examples of directional microphone array audio systems mounted as on-the-ear or in-the-ear hearing aids, eye glasses, head bands, and necklaces that sought to allow individuals with single-sided deafness or other particular hearing impairments to understand and participate in conversations in noisy environments. Among the devices proposed in the prior art is known as a cross-aid device. This device consists basically of a subminiature microphone located on the user's deaf side, with the amplified sound carried to the good ear. However, this device is ineffective when significant ambient or multi-directional noise is present. Other efforts in the prior art have been largely directed to the use of moving, rotatable conduits that can be turned in the direction that the listener wishes to emphasize (see e.g. U.S. Pat. No. 3,983,336). Alternatively, efforts have also been made in using movable plates and grills to change the acoustic resistance and thus the directive effect of a directional hearing aid (see e.g. U.S. Pat. No. 3,876,843 to Moen). Efforts have been made to increase directional properties, see U.S. Pat. No. 4,751,738 to Widrow and Bradley, and U.S. Pat. No. 5,737,430 to Widrow; however, these efforts display shortcomings in the categories of awkward or uncomfortable mounting of the microphone array and associated electronics on the person, hyper-directionality, ineffective directionality, inconsistent performance across sound frequencies, inordinate hardware and software complexity, and the like.

All of these prior devices allow in too much ambient and directional noise, instead of being focused more tightly on the desired sound source(s) and significantly reducing all off-axis sounds. This is largely due to their having beam widths so wide and side lobes so large that they captured much more than the desired sound source(s). In contrast, highly directional devices must have beam widths less than or equal to 25 degrees. In addition, prior art devices have had beam widths which varied significantly over frequency (making accurate steering more demanding) and lacked sufficient directivity gain due to the small number of microphones employed in general, and the limited effective aperture of the array.

As a result of these deficiencies, commercialized hearing aids, even augmented with prior microphone array technology, are considered ineffective by a majority of users in noisy and reverberant environments, such as restaurants, cocktail parties, and sporting events. What is needed, therefore, is a wearable directional microphone array capable of effectively filtering ambient and directional noise, while being comfortably and discreetly mounted on the user.

SUMMARY

Several objects and advantages of the present invention are:

to allow construction of a highly directional audio array that is wearable, natural sounding, and convenient to direct;

to provide directional cues to users who have partial or total loss of hearing in one or both ears;

to simultaneously provide high gain, high directivity, high side lobe attenuation, and relatively consistent beam width;

to provide significant beam forming at lower frequencies where substantial noises are present, particularly in noisy, reverberant environments;

to allow construction of a body-worn or body-carried directional audio device that is cost effective.

Another object of the present invention is a wearable directional microphone array apparatus comprising a substantially flexible printed circuit board housed in a wearable garment, the substantially flexible printed circuit board comprising at least one array panel; a plurality of sensors mounted on a first surface of the substantially flexible printed circuit board; and, at least one output connector being operably engaged with the plurality of sensors through an electrical bus configured such that a first stage of beamformed audio is transferred from the at least one output connector to an electronics module.

Yet another object of the present invention is a wearable directional microphone array system comprising at least one array panel housed in a wearable garment; a plurality of sensors mounted on a first surface of the at least one array panel; at least one output connector being operably engaged with the plurality of sensors through an electrical bus configured such that a first stage of beamformed audio is transferred from the at least one output connector to an electronics module.

Still yet another object of the present invention is a wearable directional microphone array system comprising at least two array panels, the at least two array panels being housed in a garment and connected through an interconnection cable; a plurality of sensors mounted on a first surface of the at least two array panels; at least two inter-panel connectors, the at least two inter-panel connectors being operably engaged with the plurality of sensors and operably engaged with the interconnection cable; at least one output connector being operably engaged with the at least two inter-panel connectors; and an electronics module operably engaged with the at least one output connector through an electrical bus.

Still further objects and advantages of this invention will become apparent from a consideration of the ensuing description and drawings.

DETAILED DESCRIPTION

Reference will now be made in detail to various embodiments of the invention, examples of which are illustrated in the accompanying drawings. While the invention will be described in conjunction with these embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following description of various embodiments of the present invention, numerous specific details are set forth in order to provide a thorough understanding of the present invention. In other instances, well-known methods, procedures, protocols, services, components, and circuits have not been described in detail so as not to unnecessarily obscure aspects of the present invention.

Figure 1:
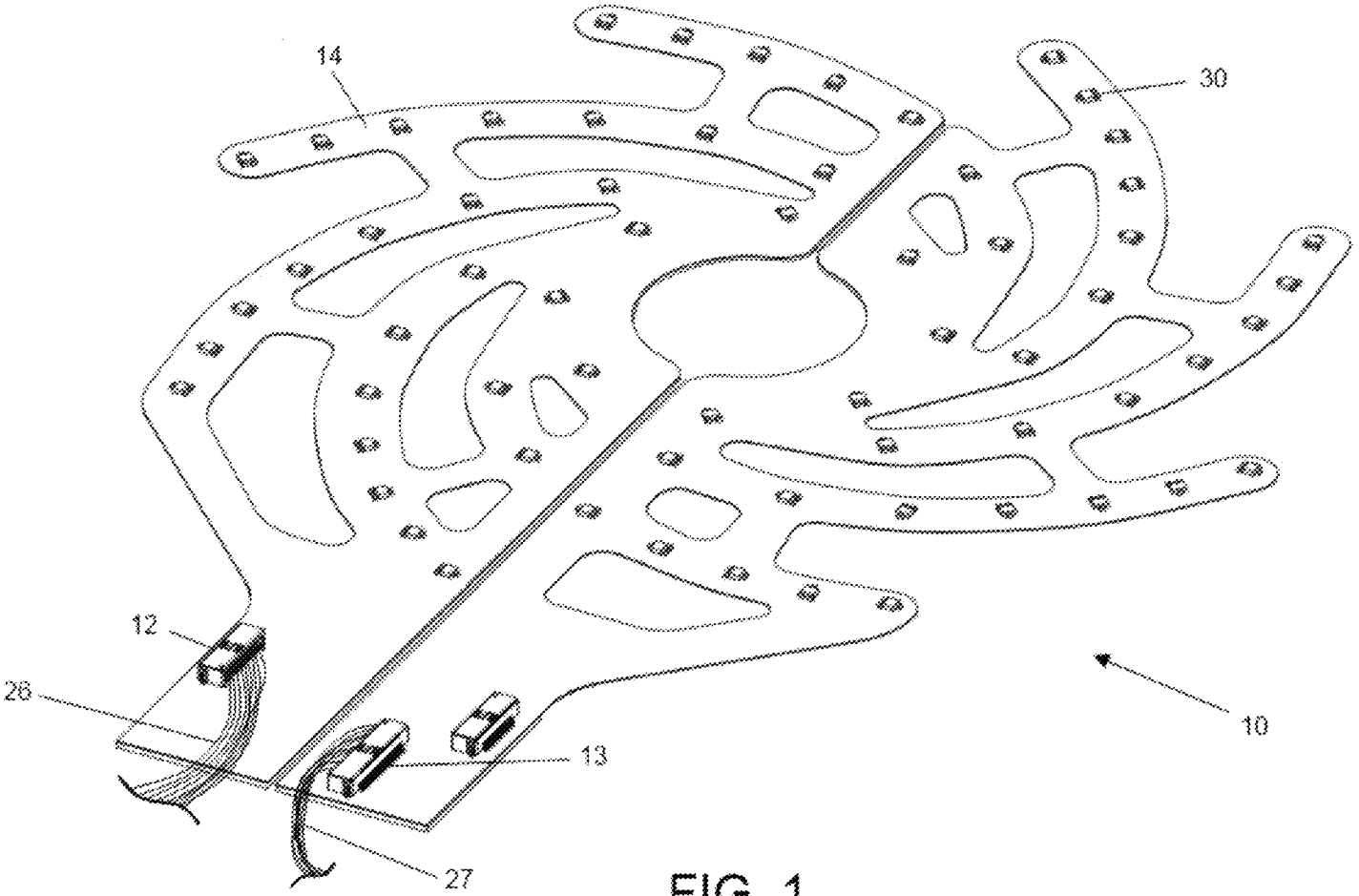
FIG. 1 is an illustration of an embodiment of the invention as a log spiral microphone array suitable for use in wearable electronics.

As shown in FIGS. 1 through 4, the present invention includes two general sections: a microphone array panel 10, which is connected to an electronic processing module 11. Referring now to the invention in more detail in an embodiment, FIG. 1 shows an illustration of an embodiment of microphone array panel 10 as a logarithmic-spiral array (also known as "log spiral"), constructed in such a manner as to make installation into a garment—such as a vest—expedient.

The construction details of the invention as shown in FIG. 1 are a logarithmic-spiral configuration of microphones mounted on a flexible printed circuit board ("PCB") material 14 with surface-mounted microphones 30 and any necessary supporting electronic components, two inter-panel connectors 12, and an output connector 13. The PCB 14 has components mounted on either one or two sides and typically has one or more layers being a metal ground plane for radio-frequency shielding purposes. The PCB 14 typically is constructed from or coated with a low friction material to minimize sound conduction into the invention by means of mechanical rubbing. In an embodiment, surface-mounted microphones 30 may be replaced with transducers, including but not limited to, acoustic sensors, acoustic renderers, and digital transducers.

Microphones 30, inter-panel connectors 12, output connector 13, and any other electronic components are typically mounted on one side of the PCB 14. The microphones 30 are typically arranged in what is known in some disciplines as a multiple-armed logarithmic spiral configuration with logarithmic spacing between the microphones. The microphones 30 are typically ported to the arriving sound pressure waves through tiny holes that go completely through the PCB 14, therefore the electronics are on one side of the array 10, while the smooth reverse side faces toward the sound source(s) of interest and helps minimizes mechanical rubbing noise against the fabric of the garment 24.

Other variations on this construction technique can be fabricated or easily conceived by any person skilled in the art, including but not limited to individually wired microphones arranged in the same or similar geometric pattern and mounted on or in a host device; substrates made of materials other than flexible PCB, such as hard PCB or even fabric with conductive wires, PCB traces, or other substances to electrically connect the microphones to the electronics module, power, and ground; other arrangements of microphones, such as fractal, equal, random, concentric circle, Golden Spiral, and Fibonacci spacing; and array panels 10 with vibration or sound absorbing layers of sound and vibration dampening materials (e.g. neoprene rubber or similar materials) on top and/or bottom.

Figure 2:
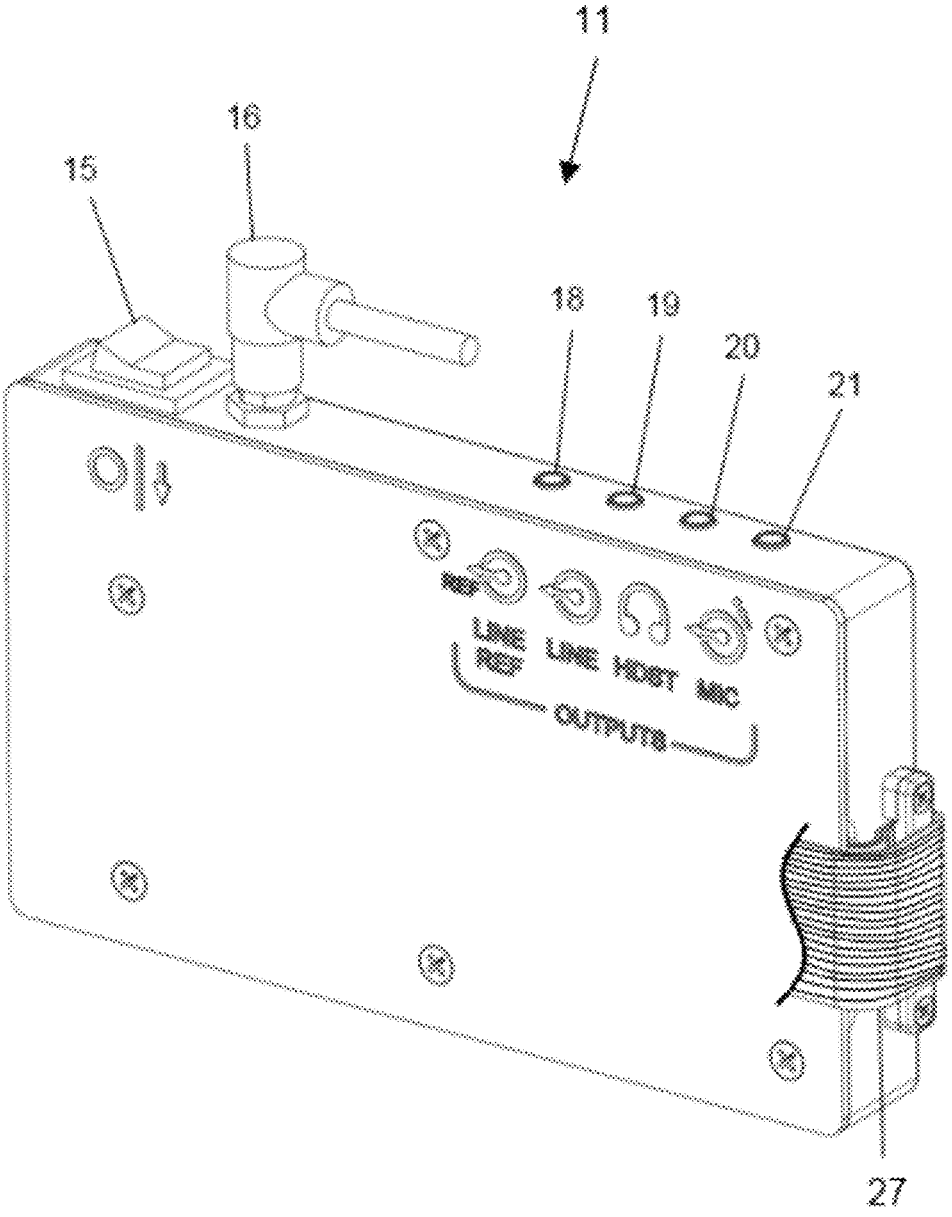
FIG. 2 is an isometric illustration of the electronics module of an embodiment of the invention.

Referring now to the invention shown in FIG. 2, the electronics module 11 connects to the array panel(s) using the electrical bus coming from the output connector 13. In more detail, still referring to the invention of FIG. 2, the electronics module includes circuitry and other components to allow it to perform additional filtering, linear and automatic gain control, noise reduction filtering, and/or signal output at multiple levels, including microphone, headphone, and/or line levels. These components are well-known in the art, are not necessary for the effective functioning of the invention, and need not be discussed at length here. The electronics module also provides for input and output of a general reference microphone channel that is not beamformed and provides a representation of the sounds reaching the array or its vicinity. The electronics module includes an on/off switch 15 and cable connection 16, which provides DC power from a remote battery pack or other electrical power source. In addition, the housing of electronics module 11 provides an output connection interface for a microphone 21, headset 20, line 19, and reference line 18.

In an embodiment, the construction details of the invention as shown in FIG. 2 are an external housing, encasing a multilayer PCB with accompanying switch, electrical jacks, and wiring. The filtering and other processing performed on the PCB are accomplished using primarily analog electronic components.

Other variations on this construction technique include, but are not limited to, embedding the electronics contained in the electronics module inside of other housings or devices or directly on PCB 14; using digital electronics, including digital signal processors (DSPs), ASICs (application specific integrated circuits), FPGA (field programmable gate arrays) and similar technologies, to implement generally the same signal processing using digital devices as is being accomplished using analog and hybrid devices in an embodiment; and the use of other transducer types including but not limited to electret microphones, accelerometers, velocity transducers, acoustic vector sensors, and digital microphones (i.e. microphones with a digital output) instead of the current MEMS (micro-electromechanical systems) microphones with analog outputs.

In an embodiment, a multi-armed log spiral arrangement possesses a beam width of approximately 25 degrees across the system bandwidth; significant gain from 64 microphones; significant attenuation of the side lobes; and natural sounding quality of beamformed audio. In this embodiment, a user experiences optimal hearing quality in noisy, reverberant environments, including a narrow beam width across the system's frequency range; a relatively equal beam width across the system's frequency range; the optimal amount of gain and side lobe attenuation, and a natural quality to the resulting beamformed audio.

Figure 3:
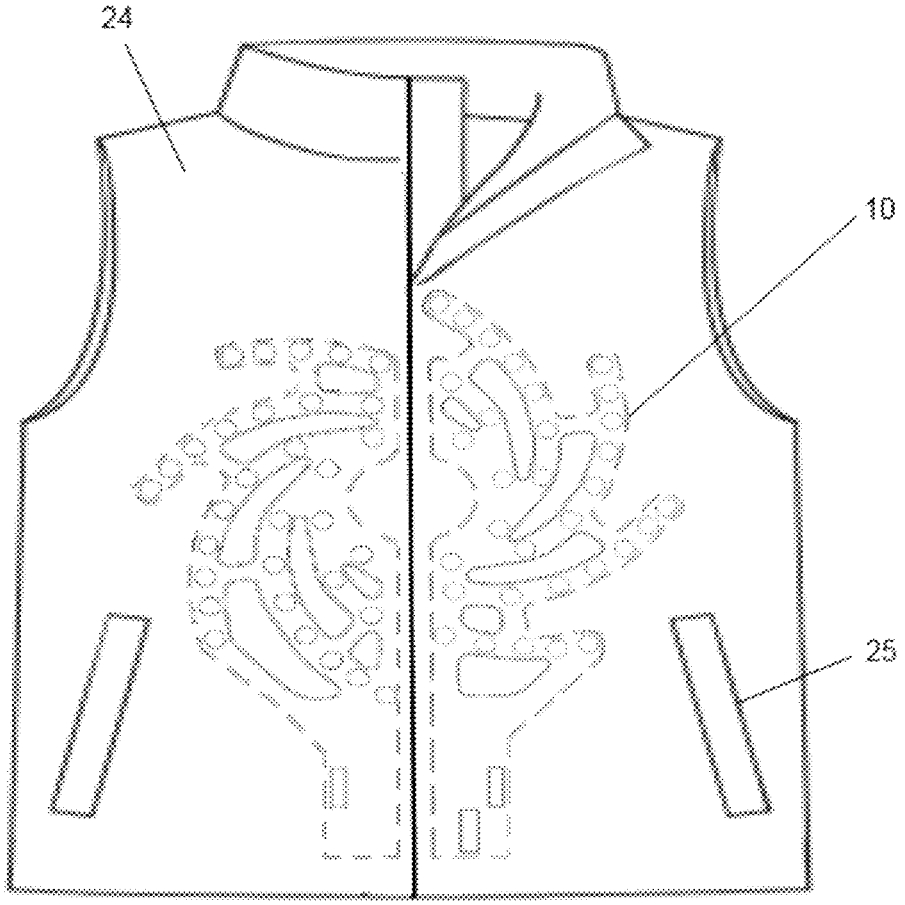
FIG. 3 is an illustration of an embodiment of the invention array installed into or worn under a vest.

Referring now to the invention shown in FIG. 3, the array panel (a log-spiral in an embodiment) is worn installed in an outer garment, such as the vest depicted in FIG. 3. In more detail, still referring to the invention of FIG. 3 of an embodiment, the array panels 10 are in each side of the zippered vest, with the two halves of the overall array connected together through the interconnection cable 26 that runs from the inter-panel connector 12 on one panel to the inter-panel connector 12 on the other. The electronics module is connected to the array panels via the output cable 27 to the output connector 13. The electronics module is carried within one pocket 25 and the batteries in the other pocket 25, so as to balance out the weight of both sides of the garment more evenly.

In an embodiment, the construction details of the invention as shown in FIG. 3 demonstrates its installation into a zippered vest garment with wired interconnection between array panels and a portable remote electronics module. Other variations on this construction technique include but are not limited to the use of wireless links to replace one or more cables; the integration of the electronics contained in the electronics module onto an array panel; the installation of the array panels into other garments, such as t-shirts, blazers, ladies' sweater vests, and the like, which may or may not have zippers and may use a short jumper cable between the array panels or be constructed of one combined array panel; the use of nanotechnology materials or other conductive fabrics and devices to both mount the components and serve as electrical connections and microphones; and the use of individually wired microphones installed directly into a garment or worn as a mesh.

Figure 4:
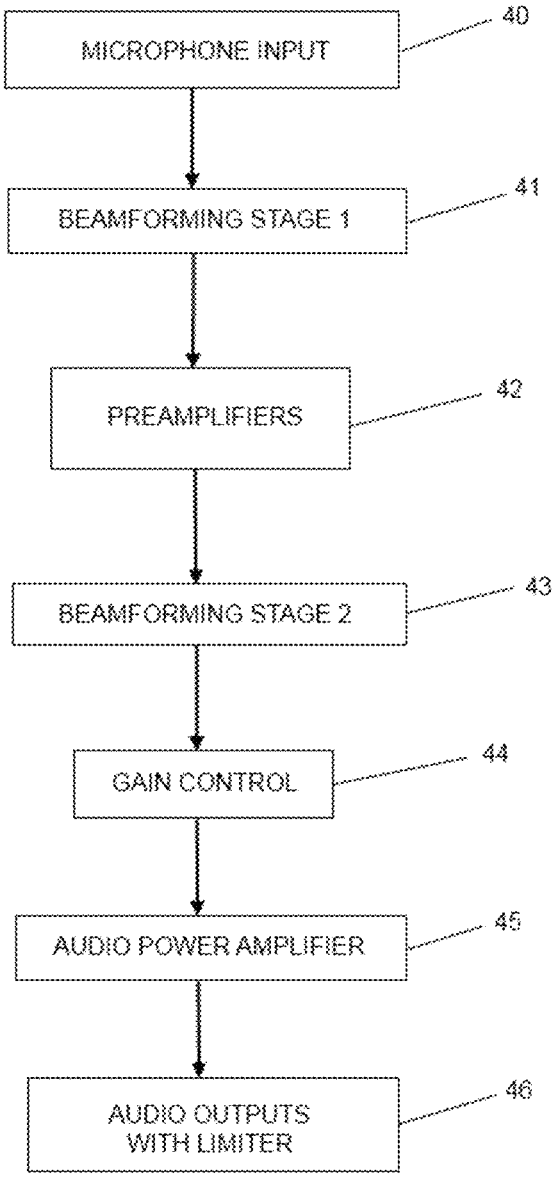
FIG. 4 is a block diagram of an embodiment of the invention including array and electronics module.

Referring now to the invention shown in FIG. 4, the functional block diagram illustrates how an embodiment acquires the sounds from the environment, processes them to filter out directional sounds of interest, and outputs the directional (beamformed) sounds for the user. In more detail, still referring to the invention of FIG. 4, multiple microphones first capture the sounds at the array 40 and the microphone signals are beamformed in groups in a first stage of beamforming 41 directly on the electrical bus of the array panel(s) 10 into multiple channels. In the electronics module 11 the pre-beamformed channels are then amplified 42 and then beamformed again in a second stage of beamforming 43. Linear or automatic gain control (including frequency filtering) 44 and audio power amplification 45 are then applied selectively prior to the directional audio being produced at line, microphone and/or headphone level 46.

Other variations on this construction technique include adding successive stages of beamforming; alternative orders of filtering and gain control; use of reference channel signals with filtering to remove directional or ambient noises; use of time or phase delay elements to steer the directivity pattern; the separate beamforming of the two panels so that directional sounds to the left (right) are output to the left (right) ear to aid in binaural listening for persons with two-sided hearing or cochlear implant(s); and the use of one or more signal separation algorithms instead of one or more beamforming stages.

The advantages of the present invention include, without limitation, (a) highly directional audio system as a body-worn or -carried assisted listening or hearing aid device;

(b) immunity to noises caused by RF interference and mechanical rubbing;

(c) low cost of construction;

(d) high reliability;

(e) tolerance to a wide range of temperature;

(f) light weight;

(g) simplicity of operation;

(h) simultaneous high gain, high directivity, and high side lobe attenuation; and (i) low power consumption.

In an embodiment, the present invention is a directional microphone array used as wearable clothing or other body-worn or -carried assisted listening or hearing aid device.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

What is claimed is:

1. A wearable directional microphone array apparatus comprising:

a substantially flexible printed circuit board comprising a first panel and a second panel housed in a wearable garment, the first panel and the second panel of the substantially flexible printed circuit board being configured as a multi-armed logarithmic spiral and being operably connected by at least one inter-panel connector;

a plurality of sensors mounted on the first panel and the second panel of the substantially flexible printed circuit board in a multi-armed logarithmic spiral configuration with logarithmic spacing between the plurality of sensors; and, at least one output connector being operable engaged with the plurality of sensors through an electrical bus configured such that a first stage of beamformed audio is transferred from the at least one output connector to an electronics module.

2. The wearable directional microphone array apparatus of claim 1 wherein the plurality of sensors are selected from the group consisting of microphones, acoustic sensors, acoustic renderers, and digital transducers.

3. The wearable directional microphone array apparatus of claim 1 wherein the electronics module further comprises circuitry operable to perform signal output to at least one channel.

4. The wearable directional microphone array apparatus of claim 1 wherein at least one surface of the substantially flexible printed circuit board is coated with a low friction material.

5. The wearable directional microphone array apparatus of claim 1 wherein the plurality of sensors are surface-mounted on one side of the first panel and the second panel of the substantially flexible printed board.

6. The wearable directional microphone array apparatus of claim 1 wherein the plurality of sensors are arranged according to a predetermined mathematical sequence.

7. The wearable directional microphone array apparatus of claim 1 further comprising a plurality of apertures defining sound ports in the substantially flexible printed circuit board, the plurality of apertures in substantial alignment with the plurality of sensors.

8. The wearable directional microphone array apparatus of claim 3 further comprising phase delay elements operable to steer a directivity pattern.

9. The wearable directional microphone array apparatus of claim 4 wherein the electronics module provides for input and output of a general reference microphone channel that is not beamformed.

10. The wearable directional microphone array apparatus of claim 9 wherein the general reference microphone channel is operable to provide a representation of sounds reaching the plurality of sensors.

11. A wearable directional microphone array system comprising:

a first array panel and a second array panel housed in a wearable garment, the first array panel and the second array panel being configured as a multi-armed logarithmic spiral and being operably connected by at least one inter-panel connector;

a plurality of sensors mounted on a surface of the first array panel and the second array panel in a multi-armed logarithmic spiral configuration with logarithmic spacing between the plurality of sensors; and, at least one output connector being operably engaged with the plurality of sensors through an electrical bus configured such that a first stage of beamformed audio is transferred from the at least one output connector to an electronics module.

12. The wearable directional microphone array system of claim 11 wherein the electronics module further comprises circuitry operable to perform signal output to at least one channel.

13. The wearable directional microphone array system of claim 11 wherein the plurality of sensors are selected from the group consisting of microphones, acoustic sensors, acoustic renderers, and digital transducers.

14. The wearable directional microphone array system of claim 11 wherein at least one surface of the first array panel and the second array panel is coated with a low friction material.

15. The wearable directional microphone array system of claim 11 wherein the electronics module provides for input and output of a general reference microphone channel that is not beamformed.

16. The wearable directional microphone array system of claim 11 wherein the array panel is constructed of a material selected from the group consisting of nanotechnology materials, conductive fabrics, individually wired sensors installed directly into a garment, and individually wired microphones installed into a fabric mesh.

17. A wearable directional microphone array system comprising:

at least two array panels being configured as a multi-armed logarithmic spiral, the at least two array panels being housed in a garment and connected through and interconnection cable;

a plurality of sensors mounted on a first surface of the at least two array panels in a multi-armed logarithmic spiral configuration with logarithmic spacing between the plurality of sensor;

at least one inter-panel connector, the at least one inter-panel connector being operably engaged with the plurality of sensors and operably engaged with the at least one inter-panel connectors;

an electronics module operably engaged with the at least one output connector through an electrical bus, the electronics module having at least one reference microphone channel.

18. The wearable direction microphone array system of claim 17 wherein the electronics module further comprises circuitry operable to perform signal output to at least one channel.

19. The wearable directional microphone array system of claim 17 wherein the electronics module is integrated onto an array panel.

20. The wearable directional microphone array system of claim 17 wherein the electronics module provides for input and output of a general reference microphone channel that is not beamformed.

* * * * *